US011168947B2

(12) United States Patent
Van Kasteren

(10) Patent No.: US 11,168,947 B2
(45) Date of Patent: Nov. 9, 2021

(54) RECUPERATOR

(71) Applicant: Recair B.V., Waalwijk (NL)

(72) Inventor: Marinus Henricus Johannes Van Kasteren, Waalwijk (NL)

(73) Assignee: Recair Holding B.V., Waalwijk (NL)

( * ) Notice: Subject to any disclaimer, the term of this patent is extended or adjusted under 35 U.S.C. 154(b) by 293 days.

(21) Appl. No.: 16/462,802

(22) PCT Filed: Nov. 27, 2017

(86) PCT No.: PCT/NL2017/050783
§ 371 (c)(1),
(2) Date: May 21, 2019

(87) PCT Pub. No.: WO2018/106102
PCT Pub. Date: Jun. 14, 2018

(65) Prior Publication Data

US 2019/0368825 A1 Dec. 5, 2019

(30) Foreign Application Priority Data

Dec. 7, 2016 (NL) ..... 2017947

(51) Int. Cl.
*F28D 21/00* (2006.01)
*F28D 9/00* (2006.01)
*F28F 3/04* (2006.01)

(52) U.S. Cl.
CPC ..... *F28D 21/0003* (2013.01); *F28D 9/0037* (2013.01); *F28F 3/046* (2013.01)

(58) Field of Classification Search
CPC ..... F28D 21/0003
See application file for complete search history.

(56) References Cited

U.S. PATENT DOCUMENTS 4,183,403 A * 1/1980 Nicholson ..... F28D 9/0068 165/166
4,724,902 A * 2/1988 Gross ..... F28D 9/0037 165/166

(Continued)

FOREIGN PATENT DOCUMENTS

EP 1 739 378 A1 1/2007
WO 2013/093375 A1 6/2013

OTHER PUBLICATIONS

International Search Report for International Application No. PCT/NL2017/050783 dated Feb. 15, 2018.

*Primary Examiner* — Nathaniel Herzfeld
(74) *Attorney, Agent, or Firm* — Suiter Swantz pc llo

(57) ABSTRACT

A recuperator including neighbouring sheets between which flow passages for air are formed. The sheets are provided with a corrugated profile including peaks, troughs and straight flanks. The peaks and troughs of a sheet are situated at an equal distance from a central plane of the sheet. Neighbouring flanks are directly connected to each other via a peak or trough. Between neighbouring flanks, first and second passage duct parts are formed which are each delimited at one end by a peak or trough and which are open at the end situated opposite the peak. In a direction at right angles to the central plane, the peaks and troughs associated with neighbouring sheets are aligned with respect to each other in such a way that first passage duct parts of a sheet and second passage duct parts associated with a neighbouring sheet are in communication with each other via connecting passage parts which extend between the troughs associated with the one sheet and peaks associated with the other sheet. The first passage duct parts, the second passage duct parts and the connecting passage parts between two sheets together form a flow passage. The smallest distance between the respective peaks and troughs which define the connecting passage parts (Continued)

is greater than 40% of the distance between neighbouring flanks.

14 Claims, 5 Drawing Sheets

(56) References Cited

U.S. PATENT DOCUMENTS

| | | | | |
|---|---|---|---|---|
| 5,623,989 | A * | 4/1997 | Kroger | F28F 1/32 165/152 |
| 5,927,097 | A | 7/1999 | Wright | |
| 6,896,043 | B2 | 5/2005 | Dunn | |
| 2002/0079085 | A1 * | 6/2002 | Rentz | F28D 9/0018 165/54 |
| 2010/0258284 | A1 * | 10/2010 | Krantz | F28F 3/083 165/166 |

* cited by examiner

RECUPERATOR

TECHNICAL FIELD AND BACKGROUND

The present invention relates to a recuperator comprising neighbouring sheets which extend parallel to each other and between which flow passages for air are formed, which sheets are each provided with a corrugated profile, which corrugated profile has peaks, troughs and straight flanks which at least extend substantially parallel to each other, in which each of the flanks interconnects a peak and a trough and is intersected by a central plane which extends parallel to the associated sheet, in which the peaks and troughs of a sheet are situated at an equal distance from the central plane of the sheet and in which neighbouring flanks are directly connected to each other, either via a peak or via a trough, and in which first passage duct parts are formed between neighbouring flanks, which are connected to each other via a peak, which passage duct parts are each delimited at one end by the respective peak and which are open at the end situated opposite the peak, and in which second passage duct parts are formed between neighbouring flanks which are directly connected to each other via a trough, which second passage duct parts are each delimited at one end by the respective trough and which are open at the end situated opposite the trough, in which furthermore, in a direction at right angles to the central plane, the peaks associated with neighbouring sheets are aligned with respect to each other and the troughs associated with neighbouring sheets are aligned with respect to each other in such a way that first passage duct parts of a sheet and second passage duct parts associated with a neighbouring sheet are in communication with each other via connecting passage parts which extend between the troughs associated with the one sheet and peaks associated with the other sheet and in which the first passage duct parts, the second passage duct parts and the connecting passage parts between two sheets together form a flow passage.

International patent application WO 2013/093375 A1 provides a description of such a heat exchanger.

BRIEF SUMMARY

It is an object of the present invention to provide a recuperator with increased efficiency. To this end, the smallest distance between the respective peaks and troughs which define the connecting passage parts is greater than 40% of the distance between neighbouring flanks at the location of the associated central plane. Where the distance between neighbouring flanks is generally mentioned below, this is understood to mean the distance between neighbouring flanks at the location of an associated central plane. The invention is based on the surprising insight that there is a relationship between, on the one hand, the ratio between the distance between peaks and troughs defining the connecting passage parts and the distance between neighbouring flanks, and, on the other hand, the efficiency with which the recuperator can be operated. In this case, the invention is firstly based on the insight that the homogeneity of an air stream through the passage duct parts and the connecting passage parts between two neighbouring sheets increases as the maximum velocity of the air between the two neighbouring sheets decreases. In general, it holds good that the maximum velocity of the air between two neighbouring sheets is achieved in those cases where the distance to the sheets is relatively great. In the area which directly adjoins the sheets, the air velocity is actually low or even zero. The invention is secondly based on the insight that the efficiency of a recuperator increases as the homogeneity of an air stream between two neighbouring sheets increases. This means that there is an inversely proportional relationship between the maximum velocity of the air between two neighbouring sheets of a recuperator and the efficiency of the recuperator. By means of computer simulations, it was determined that the maximum air velocity between two sheets in the area in which the ratio between the distance between peaks and troughs which define the connecting passage parts and the distance between neighbouring flanks is between 20% and 40% remains more or less the same. If the respective ratio becomes greater than 40%, a reduction of the maximum air velocity is seen, which results in an increase in efficiency.

When the aforementioned ratio increases further to more than 60%, the maximum air velocity is reduced still further and the efficiency consequently increases.

It has furthermore been found that if the aforementioned ratio is 85%, the maximum velocity is relatively high, as a result of which the efficiency of the recuperator is relatively low. If the ratio increases from 85%, then the maximum velocity also increases quickly. However, if the ratio decreases from 85%, the maximum velocity will initially also quickly decrease, as a result of which the efficiency will increase. In this respect, it may be preferred if the smallest distance between the peaks and troughs which define the connecting passage parts is smaller than 80% of the distance between neighbouring flanks.

In light of the above, the greatest efficiencies are achieved in the area in which the ratio between, on the one hand, the smallest distance between the respective peaks and troughs which define the connecting passage parts and, on the other hand, the distance between neighbouring flanks is situated between 40% and 85%, more specifically between 60% and 80%. In addition, in case unforeseen local freezing symptoms should occur in the connecting passage parts, air can readily avoid the ice in the flow passages, thus reducing the risk of blockage.

It has been found that a satisfactory compromise may be achieved between the various requirements which a recuperator has to meet, such as the manufacturability of the sheets, the desire to achieve a low pressure drop across the recuperator and the desired efficiency of the recuperator, can be met in particular if the ratio between the distance between a central plane and the end of an associated peak or trough and the distance between two neighbouring flanks, measured where the central plane intersects the two neighbouring flanks, is at least 1, preferably at least 1.5.

An embodiment which may be produced in practice can be obtained if the peaks and/or the troughs comprise two pointed flanks which adjoin each other via a pointed edge and enclose an angle. The use of two pointed flanks offers a good opportunity to determine the ratio between the distance between peaks and troughs which define the connecting passage parts and the distance between neighbouring flanks according to the invention. In case the sheets are stacked on top of each other, as is the case in the following embodiment, the present embodiment furthermore offers the advantage that the contacts between the neighbouring sheets via pointed edges of peaks and troughs are point contacts. A mutually correct positioning of neighbouring sheets may be achieved in a simple manner if the peaks of a sheet bear against the troughs of a neighbouring sheet. In this way, sheets can be stacked on top of each other.

Such a stack can be achieved particularly efficiently if the first passage duct parts and the second passage duct parts follow a meandering pattern and in particular if the first passage duct parts and the second passage duct parts associated with a sheet meander mirror-symmetrically with respect to a neighbouring sheet.

It may be beneficial for the efficiency of the recuperator if the meandering pattern comprises straight parts, along the length of which the first passage duct parts and the second passage duct parts associated with a sheet extend parallel to the first passage duct parts and the second passage duct parts associated with a neighbouring sheet. In the area of the straight parts, the connecting passage parts then have constant shape and size.

With a view to achieving a high degree of efficiency, it may be preferable for the flanks to extend parallel to each other in cross section.

The manufacturability of the sheets, in particular if carried out by means of dies, may benefit if the flanks, or at least the extension thereof, enclose an angle of at most 20 degrees with each other in cross section.

In general, it holds good that a satisfactory compromise may be achieved between the various requirements which a recuperator has to meet, for example with respect to manufacturability and efficiency, if the distance between the central planes of neighbouring sheets is between 2 mm and 20 mm and/or if a single period of the wave form has a length which is between 1 mm and 10 mm.

BRIEF DESCRIPTION OF THE DRAWINGS

The present invention will be explained in more detail by means of a description of a possible embodiment of a recuperator according to the invention with reference to the following figures.

DETAILED DESCRIPTION

Figure 1A:
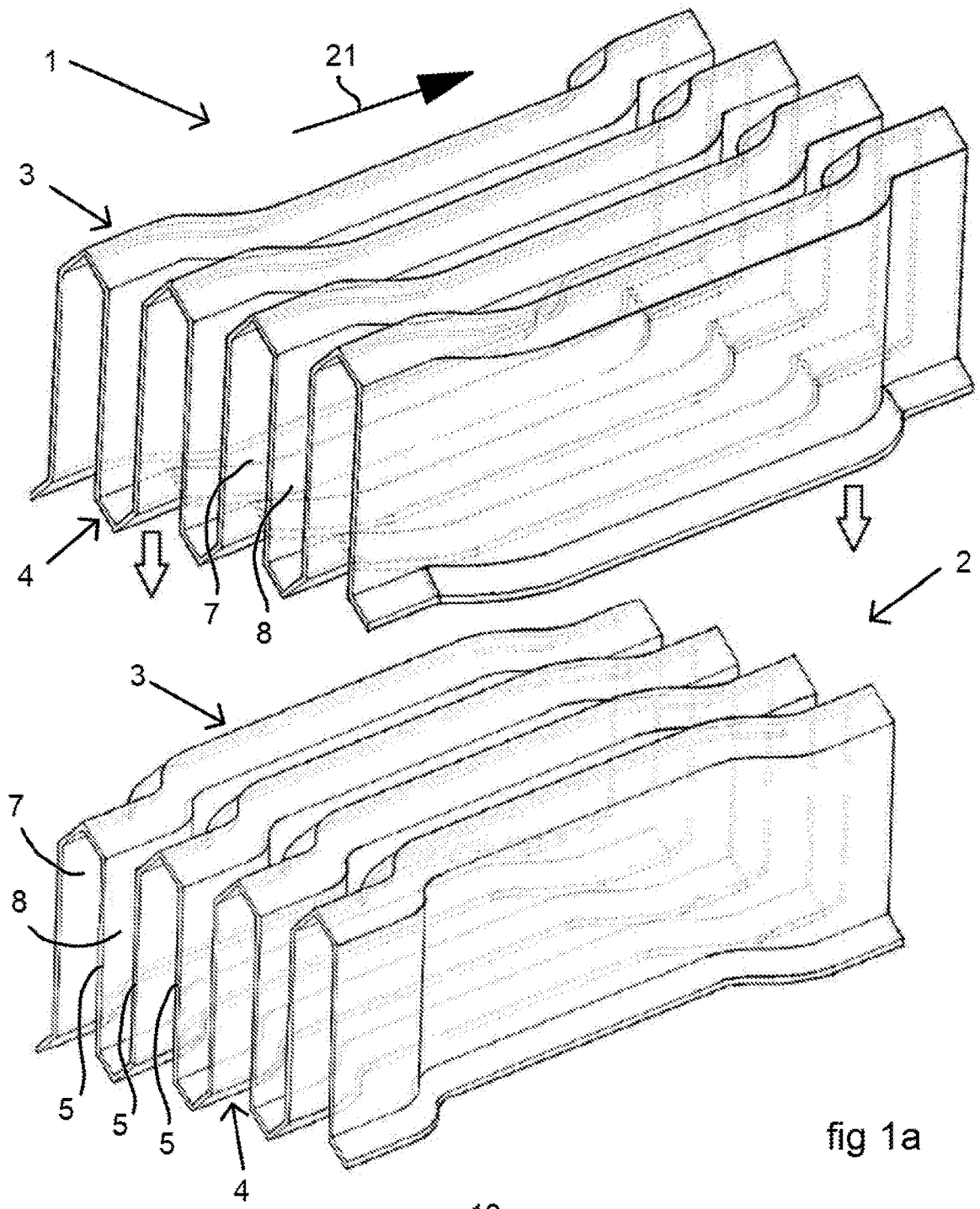
FIG. 1*a* isometrically shows an exploded view of parts of two sheets forming part of a recuperator according to the invention.

FIG. 1*a* shows an exploded view of a top sheet 1 and a bottom sheet 2, more specifically two parts thereof. The sheets 1, 2 form part of a collection of stacked sheets which in turn form part of a recuperator. The collection of sheets typically comprises a number of between 10 and 200 or even 400 sheets. Between the sheets, flow passages are formed, the shape of which will be explained in more detail. In use, air flows through the flow passages in a flow direction 21 or, on the contrary, in a direction opposite thereto. Air in neighbouring flow passages flows in opposite flow directions.

Each of the sheets has a corrugated profile. The corrugated profiles consist of peaks 3, troughs 4 and straight flanks 5. The flanks 5 extend parallel to each other in the cross section from FIG. 2. The flanks 5 connect peaks 3 and troughs 4 to each other. Each of the flanks is dissected in the middle of its longitudinal extension by an imaginary central plane 6 (see FIG. 2) which extends parallel to the associated sheet. The peaks 3 and troughs 4 are situated on opposite sides of the central plane at an equal distance therefrom. In the context of the invention, it is also possible for the flanks 5 to not be exactly parallel, but, for example mirror-symmetrically, to enclose a relatively small angle of at most 20 degrees with each other. Such a profiling facilitates detachment of sheets 1 from a die during the production process of the sheets.

A first passage duct part 7 is situated between neighbouring flanks which are directly connected to each other via a peak 3. At the end situated opposite the respective peak 3, each first passage duct part 7 is open in cross section. Second passage duct parts 8 are formed between neighbouring flanks 5 which are directly connected to each other via a trough 4, which second passage duct parts 8 are also open at the end situated opposite the trough 4.

The peaks 3 comprise two pointed flanks 3*a*, 3*b* (see FIG. 2) which are mirror-symmetrical with respect to a mirror plane which extends at right angles to the central plane 6. On one of the longitudinal edges 3*c*, 3*d*, the pointed flanks adjoin a flank 5. On the edge situated opposite the longitudinal edges 3*c*, 3*d*, the pointed flanks 3*a*, 3*b* adjoin each other at the location of pointed edge 3*e*. In a similar way, the troughs 4 comprise two pointed flanks 4*a*, 4*b*, the longitudinal edges 4*c*, 4*d* of which respectively adjoin a flank 5 and which adjoin each other via pointed edge 4*e*.

Figure 2:
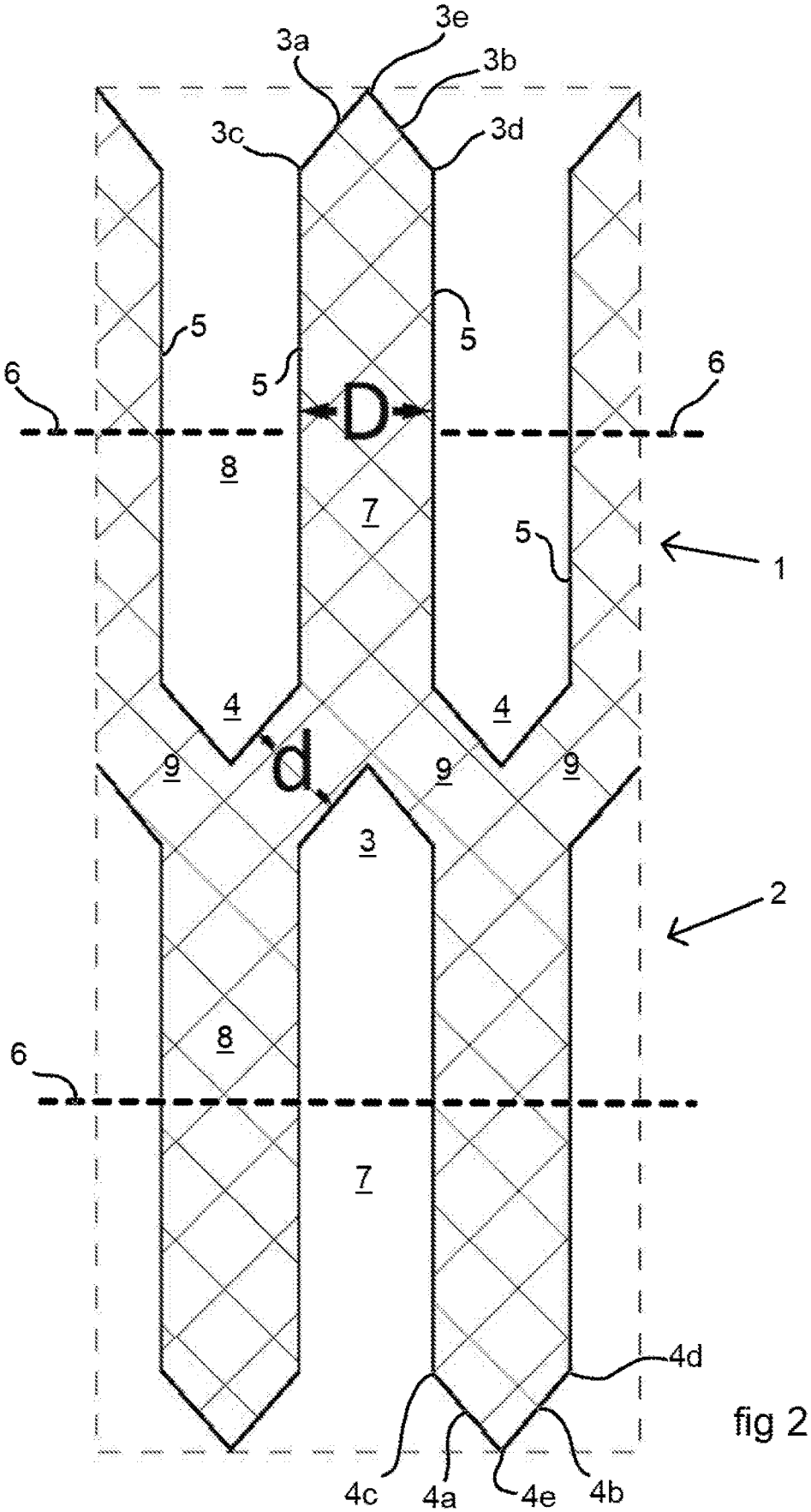
FIG. 2 shows a part of a cross section of the sheets according to FIG. 1*a* lying on top of each other.

Viewed in a direction at right angles to the central plane 6, both the peaks 3 of the sheets and the troughs 4 of the sheets are aligned with respect to each other, as can be seen, in particular, in FIG. 2. This alignment is such that first passage duct parts 7 of a top sheet 1 and second passage ducts 8 associated with a bottom sheet 2 are in communication with each other via connecting passage parts 9. These connecting passage parts 9 extend between the troughs 4 associated with the top sheet 1 and the peaks 3 associated with the bottom sheet 2. All first passage duct parts 7, second passage duct parts 8 and connecting passage parts 9 between two neighbouring sheets 1, 2 together form a flow passage, as has already been mentioned earlier. The flow passages thus extend across virtually the entire width of the sheets, which is understood to mean the dimension of the sheets viewed in a direction at right angles to the flow direction 21 and parallel to the central plane 6. At the ends of the sheets, viewed in the aforementioned width direction, neighbouring sheets 1, 2 adjoin each other in an air-tight manner. It will be clear to those skilled in the art that the ends of the flow passages are open and, viewed in the flow direction 21, are situated opposite each other.

Figure 1B:
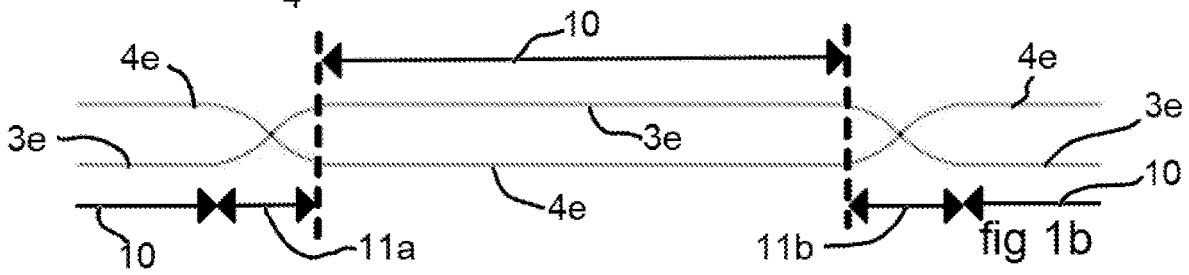
FIG. 1*b* shows a top view of two pointed edges of the two sheets according to FIG. 1*a* lying on top of each other.

In top view, the first passage duct parts 7 and the second passage duct parts 8 follow a meandering pattern. This meandering pattern comprises straight parts 10 which are connected to each other via a meandering part 11*a*, 11 *b*. The first passage ducts 7 and the second passage duct parts 8 associated with neighbouring sheets meander mirror-symmetrically with respect to each other, as is shown in FIG. 1*b*. FIG. 1*b* shows, more specifically, pointed edge 3*e* of peak 3 of a bottom sheet 2 and a pointed edge 4*e* of trough 4 associated with a top sheet 1. The pointed edges 4*e* of the top sheet 1 rest, via a point contact, on the pointed edges 3*e* of the bottom sheet 2 and that applies to all combinations of two neighbouring sheets. As those skilled in the art will understand, pointed edges 3*e* and 4*e* have the same meandering pattern as the associated first passage duct parts 7 and second passage duct parts 8. Within the length of the straight parts 10, the cross section of the flow passages is constant, as partly illustrated in FIG. 2 (see the checked part), which entails that the values for d and D are also constant within said length.

The cross section from FIG. 2 is represented, obviously to scale, in the correct ratio for a rectangular area whose width and height are in the ratio of 4 to 10. The width of this area corresponds to two periods of the wave form. The height of the area corresponds to the height of two profiles of neighbouring sheets 1, 2. The area of 4 by 10 actually corresponds to an area of 4 mm by 10 mm.

Figure 3:
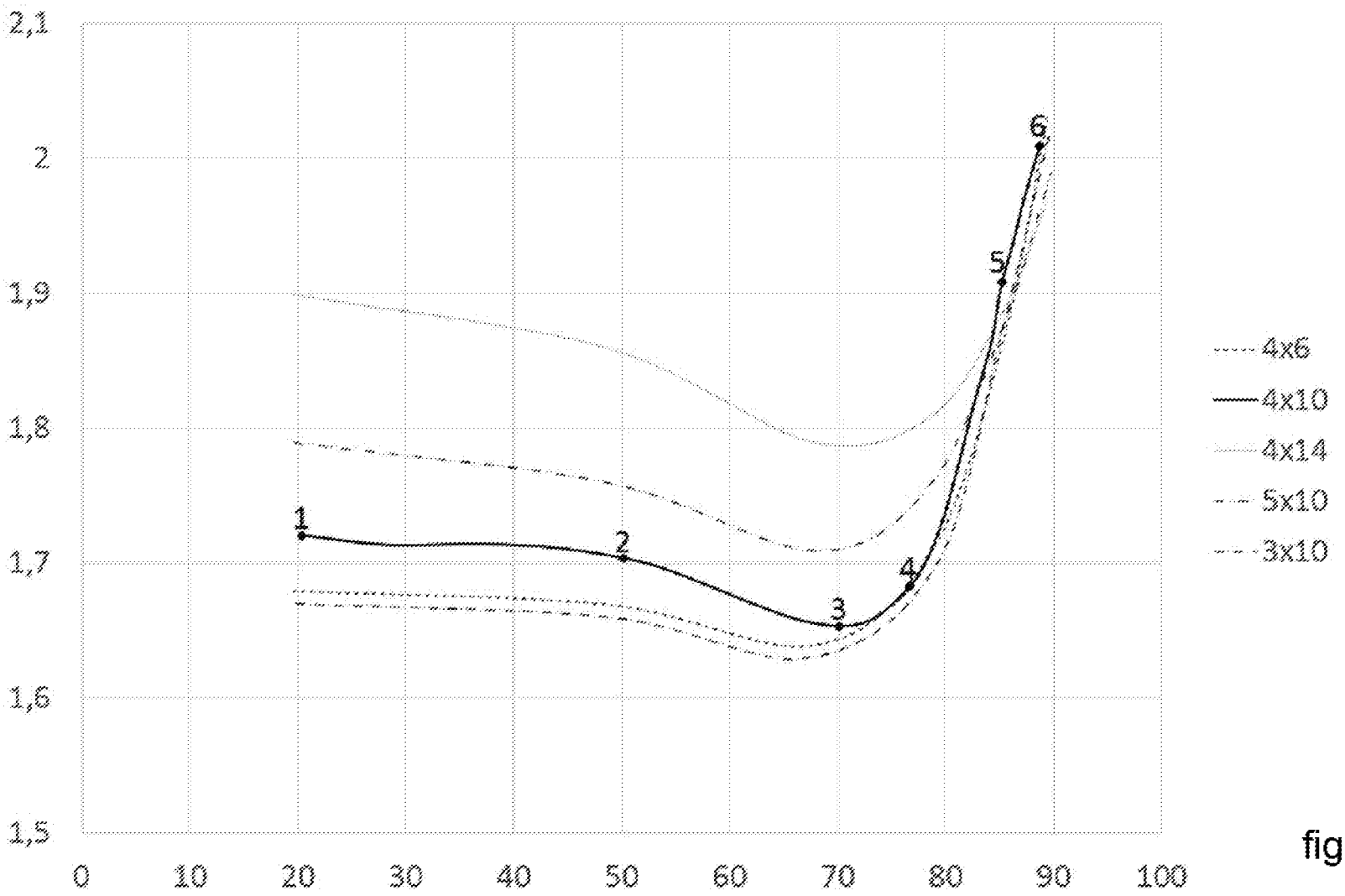
FIG. 3 shows a graph which shows the ratio d with respect to D in percent on the horizontal and a maximum flow velocity in metres per second on the vertical.
Figure 4A:
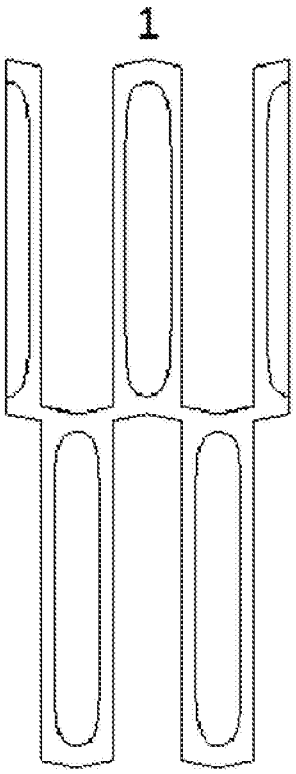
FIGS. 4*a* to 4*f* show six cross sections which are numbered 1 to 6, respectively, which numbers relate to the positions 1 to 6, as illustrated in the solid line in the graph according to FIG. 3.
Figure 4B:
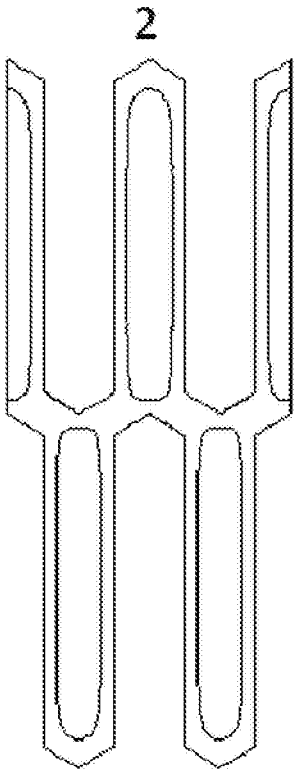
Figure 4C:
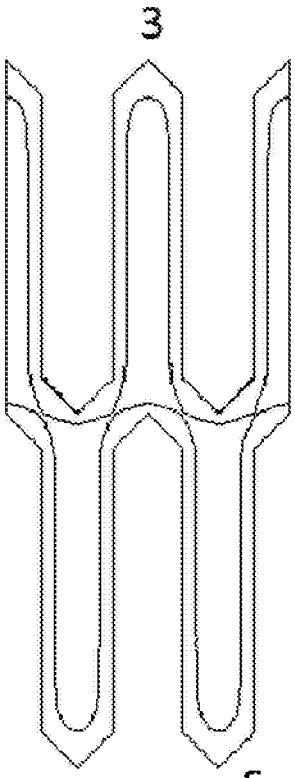
Figure 4D:
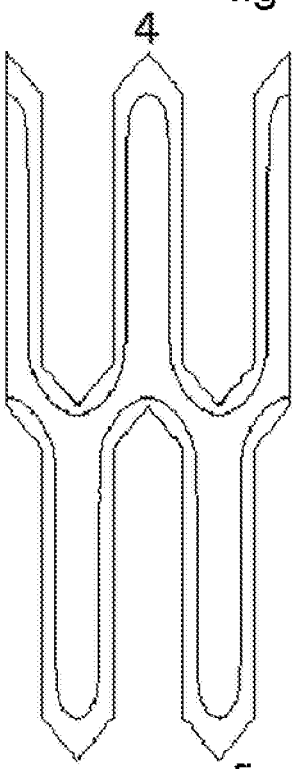
Figure 4E:
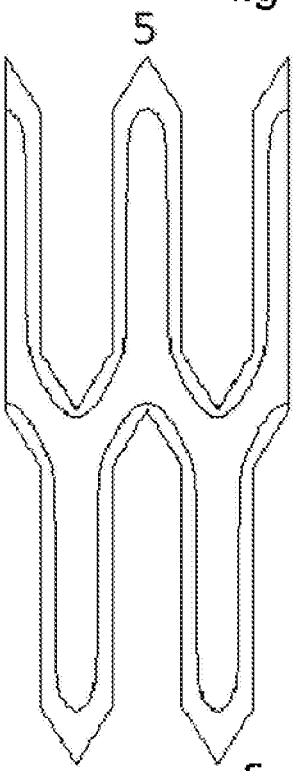
Figure 4F:
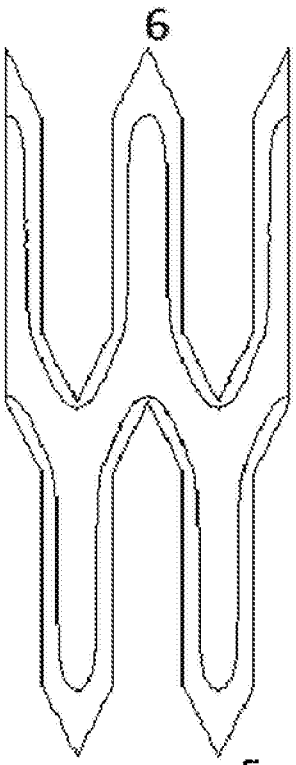

The distance between two neighbouring flanks 5 is denoted by "D". The smallest distance between the last-named peaks 3 and troughs 4, which peaks 3 and troughs 4 define the connecting passage parts 9, is denoted by "d". FIG. 3 shows a graph which is the result of a numeric simulation for the recuperator of which sheets with profiles according to FIGS. 1*a* to 2 form part. The horizontal axis shows the ratio in percent of distance d with respect to distance D. This ratio may be varied by varying the angle between the pointed flanks 3*a* and 3*b* and between the pointed flanks 4*a* and 4*b*, as is illustrated in FIGS. 4*a* to 4*f*, which show six different cross sections similar to those from FIG. 2. From cross section 1 in FIG. 4*a* to cross section 6 in FIG. 4*f*, the respective ratio increases from approximately 20% to almost 90%.

The vertical axis in FIG. 3 shows the maximum flow velocity of air in a flow passage in metres per second. The starting point in this case is that the air flow through a duct between two neighbouring sheets 1, 2 is laminar and proceeds at a mean velocity of 1 m/s. Due to resistance, the air close to the sheets will have a lower velocity than air which is situated at a greater distance from the sheets inside a flow passage. In each of the cross sections 1 to 6 in FIGS. 4*a* to 4*f*, isovelocity lines are shown for which the flow velocity equals 1 metre per second. In the area which is delimited, on the one hand, by the respective sheet, in other words by the flanks, peaks and troughs thereof, and, on the other hand, by isovelocity lines, the flow velocity is less than 1 metre per second. For the remaining part of the flow-through surface, which is thus situated on the insides of the isovelocity lines, the flow velocity is therefore greater than 1 metre per second.

The solid line in the graph from FIG. 3 relates to an area of 4 by 10, as is shown in FIG. 2. However, the ratio between the distance d and the distance D varies, as has been explained in the previous paragraph. As the solid line shows, the maximum flow velocity remains more or less the same in the area between 20% and 40%. From 40%, the maximum velocity decreases until the aforementioned ratio is 70%. From 70%, there is a relatively quick increase in the maximum velocity, with the maximum flow velocity being greater above approximately 78% than the value at 20%. The maximum velocity is an indication of the homogeneity of the respective air stream. The lower this maximum air velocity, the more homogeneous the air stream inside the flow passage and the better the air is distributed across the flow-through surface of the flow passage. The better the air is distributed across the flow-through surface, the better the recuperator will be able to exchange heat between two air streams on either side of a sheet.

The graph in FIG. 3 also shows four lines which relate to profiles having dimensions which differ from those of the profile mentioned above. For the dimensions 4 mm by 6 mm, the height of the wave form is smaller than for the dimensions 4 mm by 10 mm, whereas the height of the wave form is actually greater for the dimensions 4 mm by 14 mm. However, the length of the period of a wave of the respective wave form remains unchanged. For the dimensions 3 mm by 10 mm and 5 mm by 10 mm, the last-mentioned distance actually does change, namely is smaller and greater, respectively. However, the height of the wave form then remains unchanged.

The four graph lines for such variants show a substantially identical picture as the uninterrupted graph line for the 4 mm by 10 mm situation: a decrease from 20% up to a trough, situated in the region between 65 percent and 72 percent, and a relatively quick increase above that. Solely going by this graph, a wave form having dimensions of 3 mm by 10 mm shows a favourable picture, in the sense that the maximum flow velocity is lowest with this variant.

Ultimately, more aspects will play a role when deciding an optimum design for a recuperator, more specifically the optimum design of a profile for the sheets, such as for example the manufacturability of the sheets of a certain profile and the desire to achieve a limited pressure drop between the open ends of the flow passages.

Figure 5:
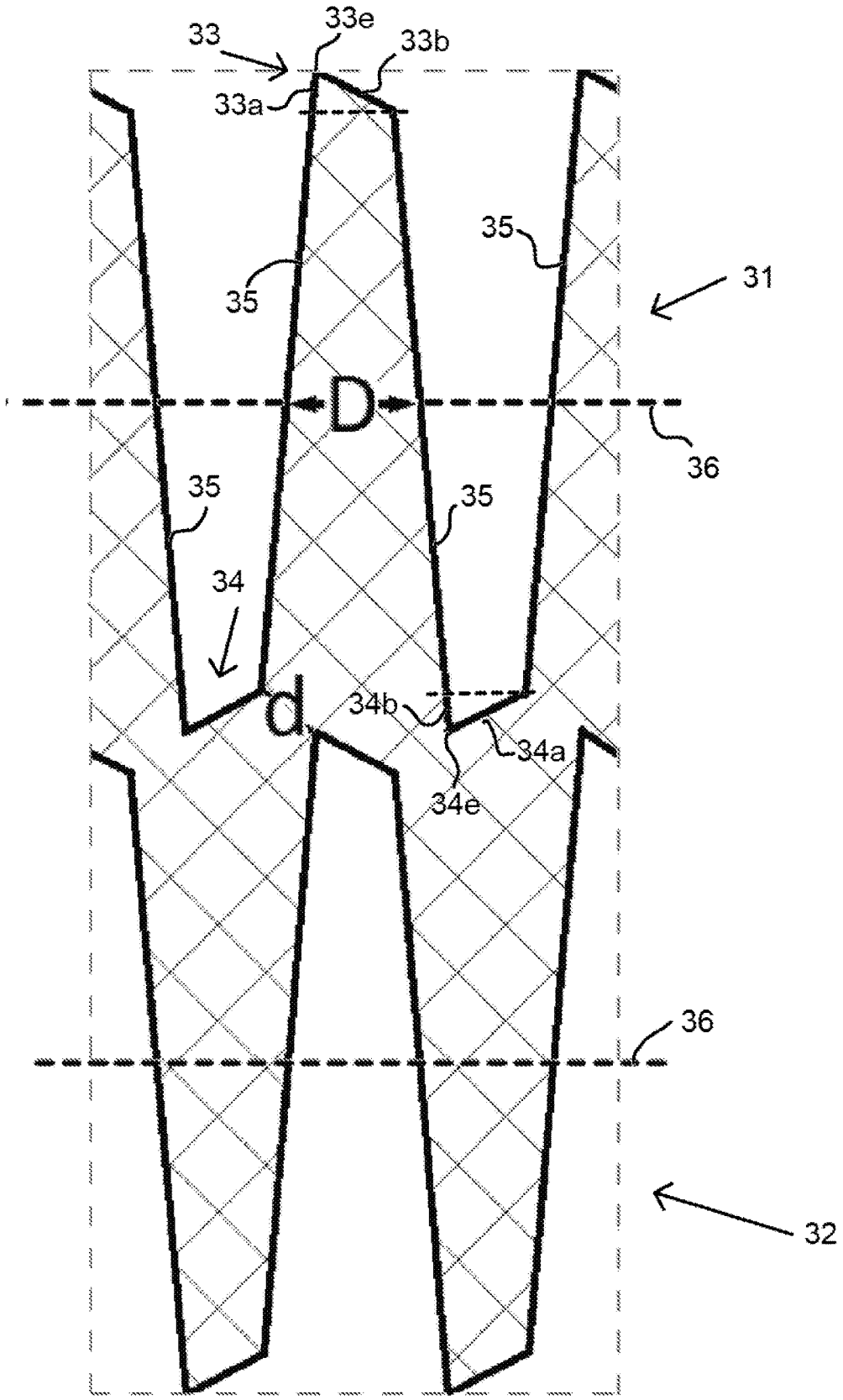
FIG. 5 shows a cross section as in FIG. 2 of an alternative embodiment of sheets as may form part of an alternative recuperator according to the invention.

FIG. 5 shows a part of two neighbouring sheets 31, 32 according to an alternative embodiment in cross section. The profiling of the sheets 31, 32 differs from that of the above-described sheets. Each of the sheets 31, 32 has peaks 33, troughs 34 and flanks 35. Neighbouring flanks 35 which adjoin a peak 33 or trough 34 lean towards each other in the direction of the respective peak 33 or trough 34 including an angle of 10 degrees. The peaks 33 and troughs 34 are identical and asymmetrical. Peaks 33 have pointed flanks 33*a* and 33*b* which, in cross section, are of unequal length and which adjoin each other at the location of pointed edge 33*e*. Pointed flank 34*a* extends in the continuation of a flank 35. Troughs 34 have pointed flanks 34*a* and 34*b*, likewise of unequal length, and pointed edge 34*e* where the pointed flanks 34*a* and 34*b* adjoin one another. Pointed flank 34*b* extends in the continuation of a flank 35. FIG. 5 also shows the central planes 36 associated with the sheets 31, 32, the distance D between neighbouring flanks 35 measured at the location of the associated central plane 36 and the smallest distance d between a peak 33 of a sheet and an opposite trough 34 of a neighbouring sheet.

The invention claimed is:

1. A recuperator comprising neighbouring sheets which extend parallel to each other and between which flow passages for air are formed, which sheets are each provided with a corrugated profile, which corrugated profile has peaks, troughs and straight flanks, in which each of the flanks interconnects a peak and a trough and is intersected by a central plane which extends parallel to the associated sheet, in which the peaks and troughs of a sheet are situated at an equal distance from the central plane of the sheet and in which neighbouring flanks are directly connected to each other, either via a peak or via a trough, and in which first passage duct parts are formed between neighbouring flanks, which are connected to each other via a peak, which passage duct parts are each delimited at one end by the respective peak and which are open at the end situated opposite the peak, and in which second passage duct parts are formed between neighbouring flanks which are directly connected to each other via a trough, which second passage duct parts are each delimited at one end by the respective trough and which are open at the end situated opposite the trough, in which furthermore, in a direction at right angles to the central plane, the peaks associated with neighbouring sheets are aligned with respect to each other and the troughs associated with neighbouring sheets are aligned with respect to each other in such a way that first passage duct parts of a sheet and second passage duct parts associated with a neighbouring sheet are in communication with each other via connecting passage parts which extend between the troughs associated with the one sheet and peaks associated with the other sheet and in which the first passage duct parts, the second passage duct parts and the connecting passage parts between two sheets together form a flow passage, characterized in that the smallest distance between the respective peaks and troughs which define the connecting passage parts is greater than 40% of the distance between neighbouring flanks at the location of the associated central plane.

2. The recuperator according to claim 1, wherein the smallest distance between the peaks and troughs which define the connecting passage parts is greater than 60% of the distance between neighbouring flanks.

3. The recuperator according to claim 1, wherein the smallest distance between the peaks and troughs which define the connecting passage parts is smaller than 85% of the distance between neighbouring flanks.

4. The recuperator according to claim 3, wherein the smallest distance between the peaks and troughs which define the connecting passage parts is smaller than 80% of the distance between neighbouring flanks.

5. The recuperator according to claim 1, wherein the ratio between the distance between a central plane and the end of an associated peak or trough and the distance between two neighbouring flanks, measured where the central plane intersects the two neighbouring flanks, is at least 1.

6. The recuperator according to claim 1, wherein the peaks and/or the troughs comprise two pointed flanks which adjoin each other via a pointed edge and enclose an angle.

7. The recuperator according to claim 1, wherein the peaks of a sheet bear against the troughs of a neighbouring sheet.

8. The recuperator according to claim 7, wherein the first passage duct parts and the second passage duct parts follow a meandering pattern.

9. The recuperator according to claim 8, wherein the first passage duct parts and the second passage duct parts associated with a sheet meander mirror-symmetrically with respect to a neighbouring sheet.

10. The recuperator according to claim 8, wherein the meandering pattern comprises straight parts, along the length of which the first passage duct parts and the second passage duct parts associated with a sheet extend parallel to the first passage duct parts and the second passage duct parts associated with a neighbouring sheet.

11. The recuperator according to claim 1, wherein the flanks extend parallel to each other in cross section.

12. The recuperator according to claim 1, wherein the flanks, or at least the extension thereof, enclose an angle of at most 20 degrees with each other in cross section.

13. The recuperator according to claim 1, wherein the distance between the central planes of neighbouring sheets is between 2 mm and 20 mm.

14. The recuperator according to claim 1, wherein a single period of the wave form has a length which is between 1 mm and 10 mm.

* * * * *